US008356969B2

(12) United States Patent
Luo et al.

(10) Patent No.: US 8,356,969 B2
(45) Date of Patent: Jan. 22, 2013

(54) PUMPING UNIT

(75) Inventors: Benjin Luo, Stuttgart (DE); Joerg Sigrist, Ludwigsburg (DE); Andreas Gutscher, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 669 days.

(21) Appl. No.: 12/444,054

(22) PCT Filed: Sep. 17, 2007

(86) PCT No.: PCT/EP2007/059753

§ 371 (c)(1),
(2), (4) Date: Jan. 25, 2010

(87) PCT Pub. No.: WO2008/040629

PCT Pub. Date: Apr. 10, 2008

(65) Prior Publication Data

US 2010/0166555 A1 Jul. 1, 2010

(30) Foreign Application Priority Data

Oct. 2, 2006 (DE) ..... 10 2006 046 827

(51) Int. Cl.
*F04D 5/00* (2006.01)
*F04D 29/40* (2006.01)

(52) U.S. Cl. ..... 415/55.1; 415/55.2; 415/55.3; 415/55.4; 417/423.1; 417/423.14

(58) Field of Classification Search ..... 415/55.1, 415/55.2, 55.3, 55.4, 55.5, 55.6, 55.7, 169.1; 417/423.1, 423.14

See application file for complete search history.

(56) References Cited

U.S. PATENT DOCUMENTS

| | | | | |
|---|---|---|---|---|
| 5,149,252 | A * | 9/1992 | Tuckey et al. | 415/55.6 |
| 5,336,045 | A * | 8/1994 | Koyama et al. | 415/55.1 |
| 5,399,075 | A | 3/1995 | Frank et al. | |
| 5,401,147 | A * | 3/1995 | Yu | 415/55.1 |
| 5,486,087 | A | 1/1996 | Treiber et al. | |
| 5,551,835 | A | 9/1996 | Yu et al. | |
| 5,558,490 | A * | 9/1996 | Dobler et al. | 415/55.1 |

(Continued)

FOREIGN PATENT DOCUMENTS

| | | |
|---|---|---|
| DE | 4201401 A1 | 7/1993 |
| DE | 4343078 A1 | 6/1995 |

(Continued)

*Primary Examiner* — Igor Kershteyn
(74) *Attorney, Agent, or Firm* — Michael Best & Friedrich LLP

(57) ABSTRACT

Pumping units are known to have an inlet channel, opening out into a pumping channel and tapering from an inlet cross section to an outlet into the pumping channel with an outlet cross-section. The flow is deflected through ninety degrees on entry to the pumping channel which induces strong swirling. The transition from the inlet channel into the pumping channel is not optimal for flow. This effect reduces the efficiency of the pumping unit. The inlet flow into the pumping channel is improved in the pumping unit according to the invention and hence efficiency is improved. According to the invention, the outlet is essentially provided in a first quadrant with relation to the inlet cross section and the tapering of the inlet channel essentially occurs in the other three quadrants. The tapering wall of the inlet channel is formed by a plane-generating shape which goes around from one side of the outlet to the other side of the outlet and is shaped to be increasingly flat relative to a plane of the outlet.

9 Claims, 5 Drawing Sheets

U.S. PATENT DOCUMENTS

| | | | | |
|---|---|---|---|---|
| 6,287,093 | B1 | 9/2001 | Huebel et al. | |
| 6,296,440 | B1 * | 10/2001 | Fandrey | 415/55.1 |
| 6,655,909 | B2 * | 12/2003 | Yu et al. | 415/55.1 |
| 6,767,181 | B2 * | 7/2004 | Yu et al. | 415/55.1 |
| 7,025,561 | B2 * | 4/2006 | Honda et al. | 415/55.1 |
| 2005/0074343 | A1 | 4/2005 | Naito | |

FOREIGN PATENT DOCUMENTS

| | | | |
|---|---|---|---|
| DE | 19757580 | A1 | 7/1999 |
| GB | 2262567 | A | 6/1993 |

* cited by examiner

PUMPING UNIT

CROSS-REFERENCE TO RELATED APPLICATION

This application is a 35 USC 371 application of PCT/EP 20071059753 filed on Sep. 17, 2007.

BACKGROUND OF THE INVENTION

1. Field of the Invention

The invention is based on a pumping unit.

2. Description of the Prior Art

DE 43 00 845 A1 has already disclosed a pumping unit having an inlet conduit that is connected to a pump chamber containing a rotor and to a pumping conduit and narrows from an inlet cross section to an outlet cross section at an outlet into the pumping conduit. The flow is deflected by 90 degrees as it flows into the pumping conduit, inducing a comparatively powerful turbulence in it. The transition from the inlet conduit into the pumping conduit is not optimal for flow. This effect reduces the efficiency of the pumping unit.

ADVANTAGES AND SUMMARY OF THE INVENTION

The pumping unit according to the invention, has the advantage over the prior art that the turbulence is reduced through a gentle transition from the inlet conduit into the pumping conduit and thus increases the efficiency of the pumping unit. This is achieved according to the invention in that the outlet is essentially provided in a first quadrant in relation to the inlet cross section and the narrowing of the inlet conduit occurs essentially in the other three quadrants, wherein the narrowing wall of the inlet conduit is formed by a plane-forming contour that extends around from one side of the outlet to the other side of the outlet and is embodied so that as it does so, it becomes increasingly flat in relation to a plane of the outlet.

This embodiment according to the invention also improves the hot fuel behavior of the pumping unit since the heated fuel emits less gas than in the prior art due to the low turbulence.

It is particularly advantageous if the plane-forming contour extends curved in an S-shape, with one curve oriented toward the outside and a curve following it in the flow direction oriented toward the inside since this achieves a continuous transition into the pumping conduit. The plane-forming contour begins in a plane spaced axially apart from the outlet and transitions continuously, viewed in the axial direction, into the plane of the outlet.

It is very advantageous if the plane-forming contour forms a step-shaped shoulder on the one side of the outlet, which transitions continuously into the plane of the outlet viewed in the circumference direction, since the flow entering into the inlet conduit is thus swirled and guided toward the outlet in the circumference direction of the inlet conduit.

According to an advantageous embodiment, the step-shaped shoulder is embodied as rounded; it is rounded more and more as it extends in the circumference direction and transitions with an larger and larger radius into the plane of the outlet.

Is also advantageous if the radial dimension of the inlet conduit remains essentially constant in the axial direction in the region of the first quadrant and one side of the outlet is situated in this section of the inlet conduit.

It is also advantageous if the outlet is embodied as triangular and has two straight sides and one circular side.

BRIEF DESCRIPTION OF THE DRAWINGS

An exemplary embodiment of the invention will be explained in greater detail in conjunction with the drawings, in which.

DESCRIPTION OF THE PREFERRED EMBODIMENT

Figure 1:
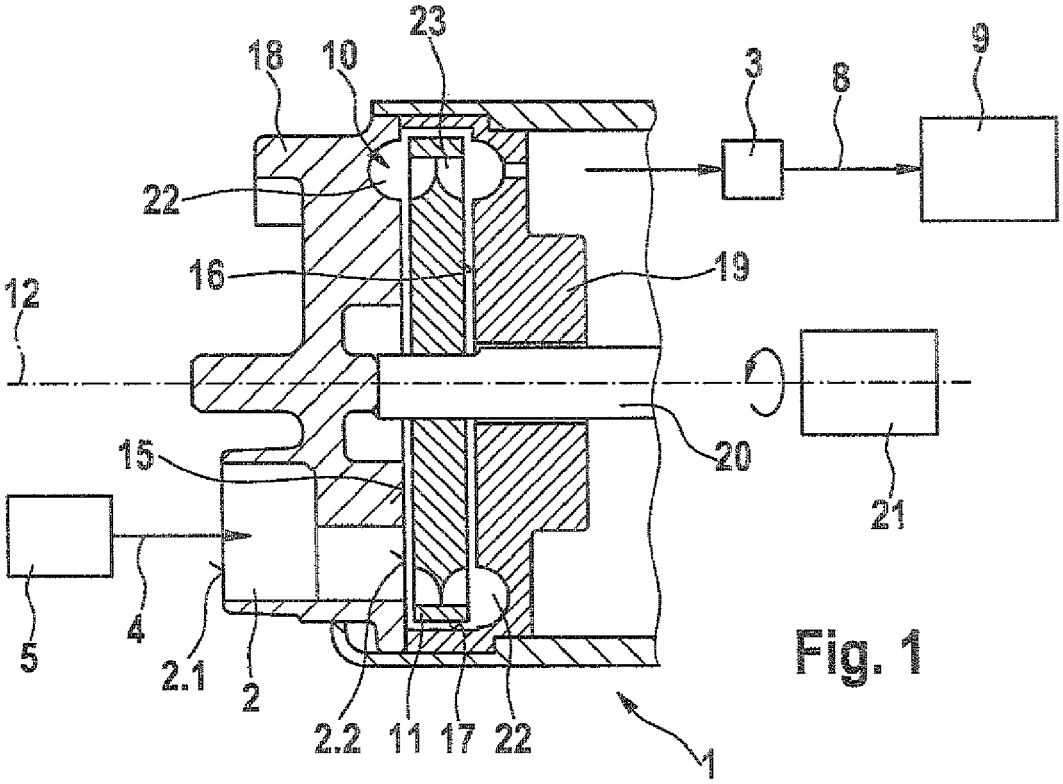
FIG. 1 shows a section through a schematically depicted pumping unit in which the embodiment of the inlet conduit according to the invention could be used.

FIG. 1 shows a section through a schematically depicted pumping unit in which the invention could be used.

The pumping unit is used for pumping fluid, for example fuel, out of a storage tank to a consumer, for example an internal combustion engine. The pumping unit can be either a flow pump or a displacement pump.

The pumping unit has a pump housing 1 with at least one inlet conduit 2 and one outlet conduit 3. The inlet conduit 2 of the pumping unit is connected, for example via an intake line 4, to a storage tank 5 that serves to store fuel, for example. The outlet conduit 3 is connected via a pressure line 8 to an internal combustion engine 9, for example.

The pump housing 1 has a pump chamber 10 in which a rotor 11 rotates around a rotationally symmetrical pump axis 12. The pump chamber 10 is delimited by two end walls 15, 16 situated opposite each other in the direction of the pump axis 12 and is delimited in the radial direction in relation to the pump axis 12 by a circumference wall 17.

The first end wall 15 is embodied, for example, on a suction cover 18 and the second end wall 16 is embodied on a pressure cover 19. The circumference wall 17 is embodied on the pressure cover 19, for example, but can also be a separate component provided between the suction cover 18 and the pressure cover 19. The suction cover 18 and the pressure cover 19 enclose the pump chamber 10.

The rotor 11 is used for pumping fluid and produces a predetermined pressure downstream of the pump chamber 10. For example, the rotor 11 is embodied as a turbine rotor disk. The embodiment of the rotor 11, however, is expressly arbitrary. The rotor 11 is driven via a drive shaft 20 by an actuator 21, for example an electric motor.

The rotor 11 is supported on the drive shaft 18, for example, so that it is able to move axially between the end walls 15, 16.

According to one exemplary embodiment, at least one annular pumping conduit 22 is respectively embodied in each of the end walls 15, 16. The pumping conduits 22 have a semicircular or U-shaped cross section and cooperate with pumping blades 23 of the rotor 11. They are thus situated in the vicinity of the pumping blades 23, viewed in the radial direction.

Figure 2:
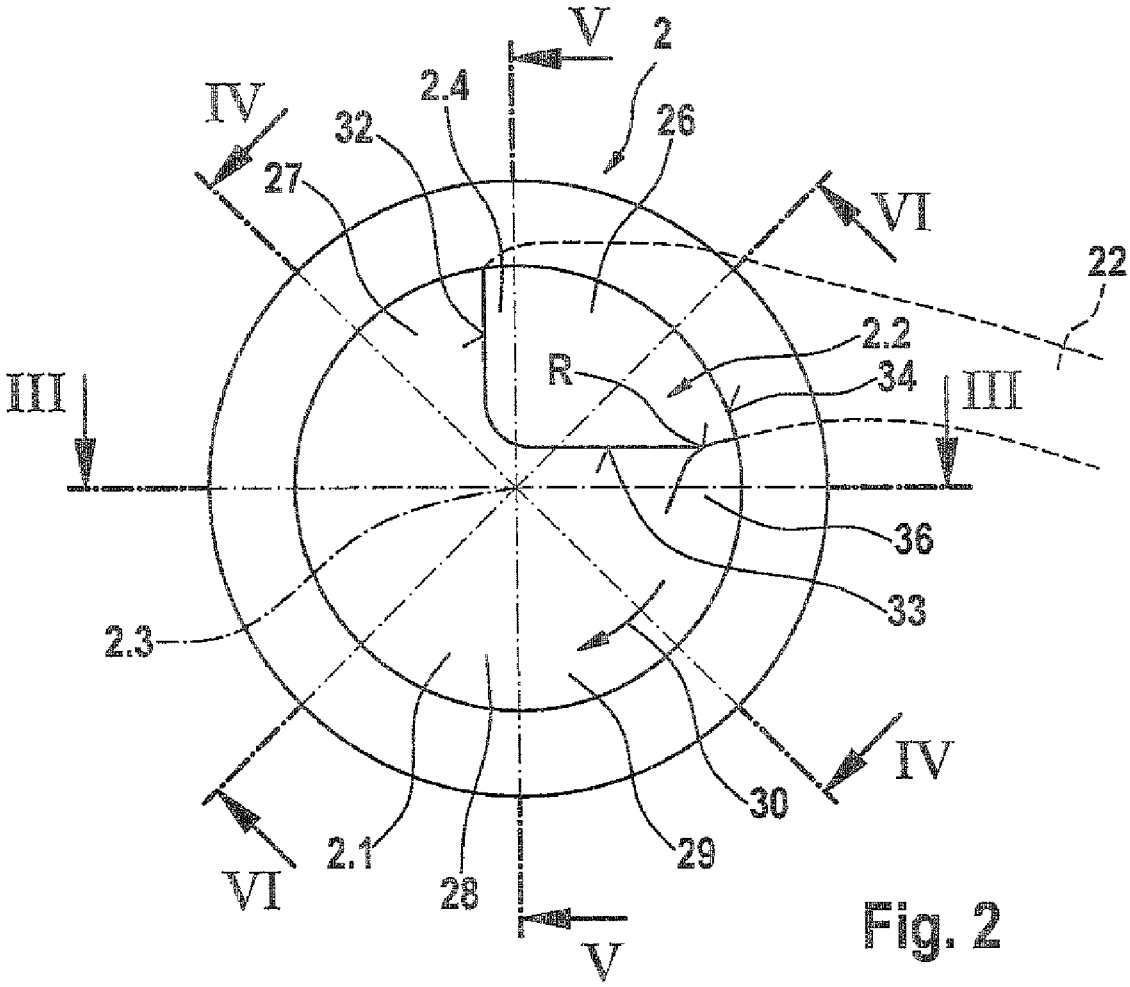
FIG. 2 shows a view into the inlet conduit according to FIG. 1.

FIG. 2 is a top view of the inlet conduit according to FIG. 1.

The inlet conduit 2 narrows starting from an inlet cross section 2.1 to an outlet 2.2 into the pump chamber 10. The inlet cross section 2.1 is embodied as circular, for example, but can also be embodied in any other shape such as square, rectangular, oval, or the like.

The outlet 2.2 into the pump chamber 10 is situated at the end of the inlet conduit 2 and, in a division of the inlet cross section 2.1 into four equal-sized quadrants in relation to the inlet cross section 2.1, is essentially provided in a first quadrant 26 of the inlet cross section 2.1. The radial dimension, for example the diameter, of the inlet conduit 2 remains essentially constant in the axial direction in the vicinity of the first quadrant 26, but can also change slightly in stepped fashion due to the lateral feeding-in of a pumping conduit 22 into the inlet conduit 2.

The first quadrant 26 is provided between 0 and 90 degrees, the second quadrant 27 is provided between 90 and 180 degrees, the third quadrant 28 is provided between 180 and 270 degrees, and the fourth quadrant 29 is provided between 270 and 360 degrees. With regard to a coordinate system situated at a center point 2.3 of the inlet cross section 2.1, the first quadrant 26 is situated at the upper right, the second quadrant 27 is situated at the upper left, the third quadrant 28 is situated at the lower left, and the fourth quadrant 29 is situated at the lower right.

The edges of the outlet 2.2, which are visible in the top view, form a circular segment shape with two straight sides 32, 33 and one circular side 34. It is also expressly possible for it to have any other shape such as circular, triangular, square, rectangular, oval, or the like. The circular side 34 of the outlet 2.2 is situated in the first quadrant 26, for example close to or at the circumference wall of the inlet conduit 2. The first side is oriented toward the second quadrant 27 and the second side 33 is oriented toward the fourth quadrant 29.

For example, the outlet 2.2 protrudes with a partial section 2.4 into the second quadrant 27. The partial section 2.4 is less than 30 percent of the total cross section of the outlet 2.2.

The straight sides 32, 33 of the outlet 2.2 are situated in the plane of the end wall 15 of the suction cover 18. The edge circular side 34 of the outlet 2.2 is spaced apart from the plane of the end wall 15 since in this region, the pumping conduit 22 opens into the inlet conduit 2, as shown with dashed lines in FIG. 2. Thus in the plane of the end wall 15, the outlet 2.2 feeds with a first surface section into the pump chamber 10 and feeds with another surface section into the pumping conduit 22. The fluid flowing in through the inlet conduit 2 flows via the first surface section directly into the pumping blades 23 of the rotor 11 and, via the other surface section, flows first into the pumping conduit 22 and then into the pumping blades 23.

Figure 3:
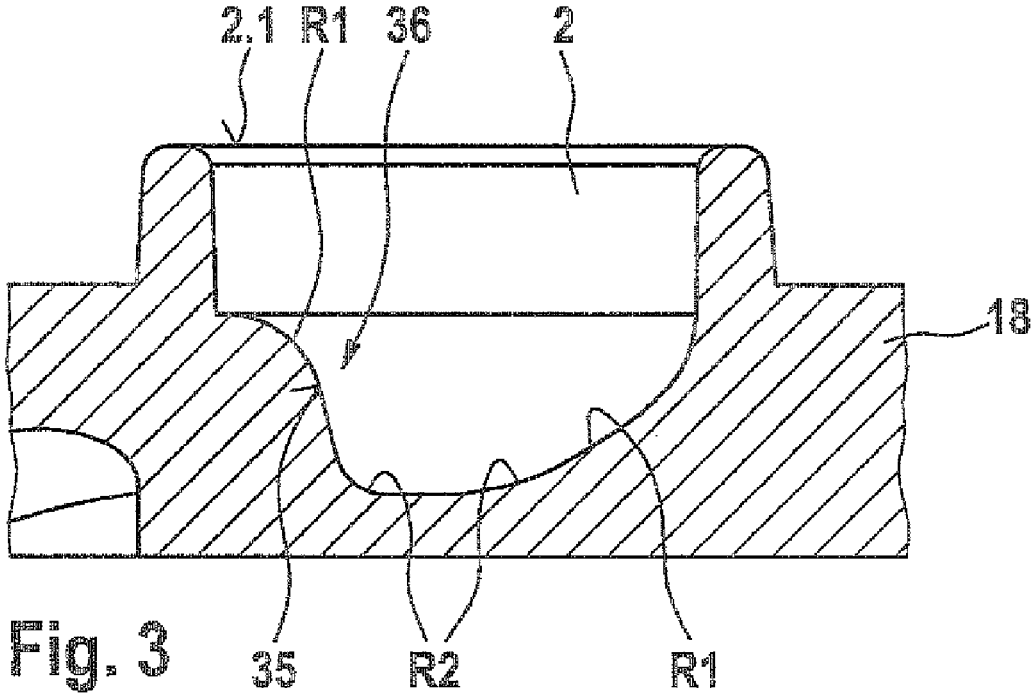
FIG. 3 shows a first sectional view along the line III-III in FIG. 2.

According to the invention, the narrowing of the inlet conduit 2 occurs essentially in the other three quadrants 27, 28, 29, with the narrowing wall of the inlet conduit 2 being formed by a plane-forming contour 35 (FIG. 3). The plane-forming contour 35 begins spaced axially apart from the plane of the outlet 2.2.

Viewed in the circumference direction, this contour starts from one side 32, 33 of the outlet 2.2 or from close to this side 32, 33 and extends around to at least close to the other side 32, 33 of the outlet 2.2 in the circumference direction of the inlet conduit 2. In a circumference direction 30 indicated with an arrow, from the second side 33 of the outlet 2.2 through the fourth and third quadrants 29, 28, the contour 35 is embodied as increasingly flat in relation to the plane of the outlet 2.2. Viewed in the opposite circumference direction, the contour 35 naturally becomes more steeply inclined. Close to the first side 32 of the outlet 2.2, the plane-forming contour 35 transitions continuously into the plane 15 of the sides 32, 33 of the outlet 2.2. This achieves a very gentle transition into the pumping conduit 22 extending perpendicular to the inlet conduit 2 so that the flow experiences less powerful turbulence in the pumping conduit 22. This increases the efficiency of the pumping unit and achieves a better hot fuel behavior with less formation of gas bubbles in the pumping conduit 22.

At or near the second side 33 of the outlet 2.2, the contour 35 forms a step-shaped shoulder 36, for example, which transitions continuously into the plane of the sides 32, 33 of the outlet 2.2 in the circumference direction 30, i.e. the plane of the end wall 15. The shoulder 36 has an edge, for example a radius R1, that extends down into the deepest part.

The curve of the contour 35 according to the invention and of the narrowing wall of the inlet conduit 2 is depicted in the sectional views that follow.

FIG. 3 shows a first sectional view along the line III-III in FIG. 2.

In the view according to FIG. 3, parts that remain the same or that function in the same manner as those in the pumping unit according to FIGS. 1 and 2 have been labeled with the same reference numerals.

The step-shaped shoulder 36 formed by the contour 35 is rounded with a radius R1, for example, at its protruding edge. From the for example rounded edge, the contour 35 extends in a sloped, relatively steep fashion in relation to the plane of the outlet 2.2 and transitions with a radius R2 continuously in the plane 32, 33 of the outlet 2.2. According to this exemplary embodiment, the radius R1 and/or the radius R2 of the step-shaped shoulder 36 increases in the circumference direction 30, for example continuously.

The plane-forming contour 35 is embodied as curved in such a way that the flow traveling into the inlet conduit 2 is guided in the circumference direction 30 of the inlet conduit 2 toward the outlet 2.2.

According to one embodiment, the plane-forming contour 35 is curved in an S-shape, with a first curve protruding outward into the conduit 2 with the radius R1 and with a second curve situated downstream of it in the flow direction that curves inward with the radius R2.

Figure 4:
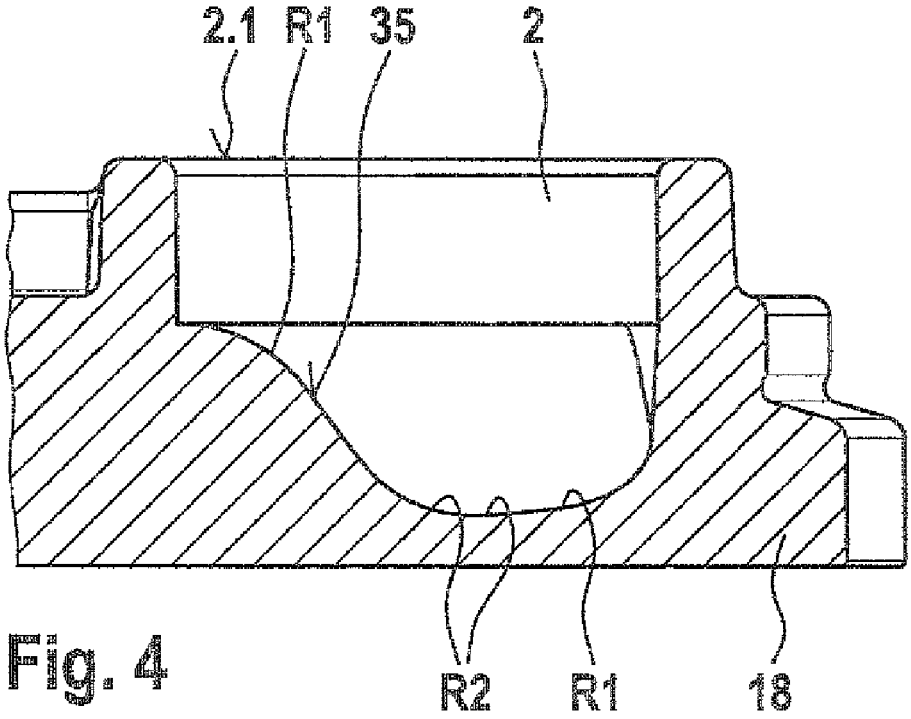
FIG. 4 shows a second sectional view along the line IV-IV in FIG. 2.

FIG. 4 shows a second sectional view along the line IV-IV in FIG. 2.

In the view according to FIG. 4, parts that remain the same or that function in the same manner as those in the pumping unit according to FIG. 1 through FIG. 3 have been labeled with the same reference numerals.

Figure 5:
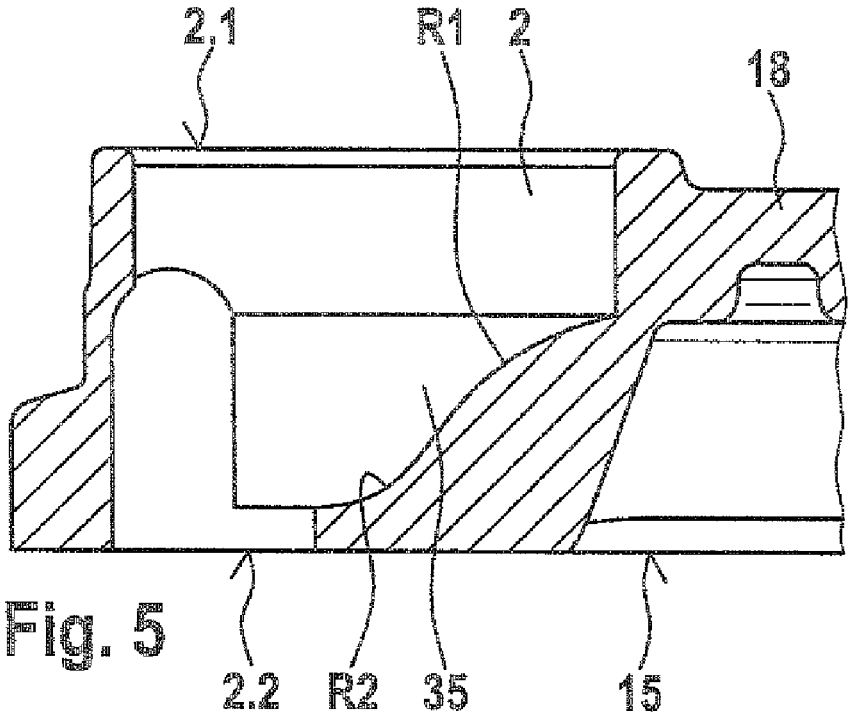
FIG. 5 shows a third sectional view along the line V-V in FIG. 2.

FIG. 5 shows a third sectional view along the line V-V in FIG. 2.

In the view according to FIG. 5, parts that remain the same or that function in the same manner as those in the pumping unit according to FIG. 1 through FIG. 4 have been labeled with the same reference numerals.

Figure 6:
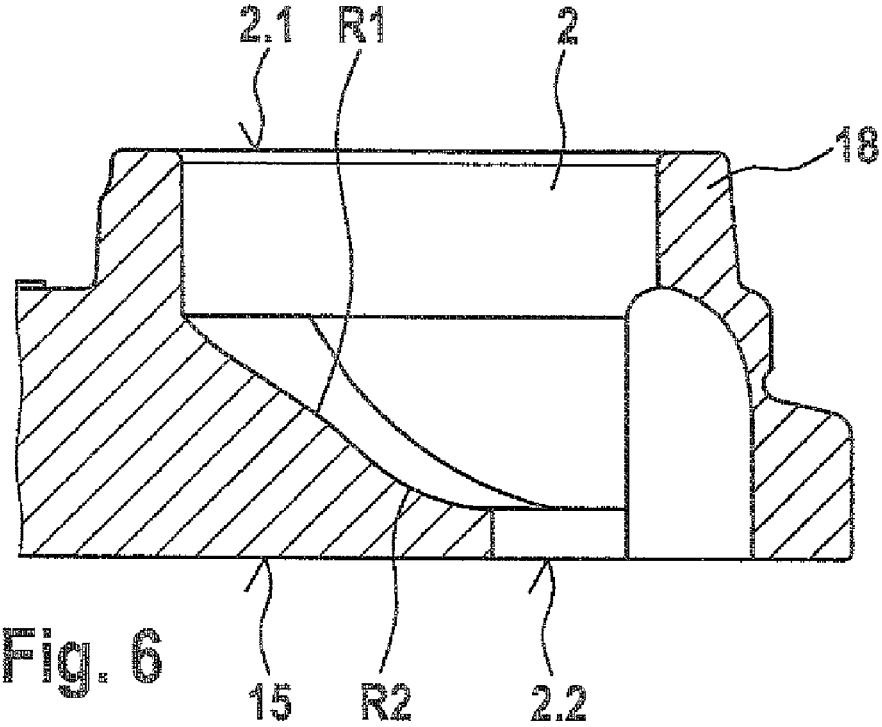
FIG. 6 shows a fourth sectional view along the line VI-VI in FIG. 2.

FIG. 6 shows a fourth sectional view along the line VI-VI in FIG. 2.

In the view according to FIG. 6, parts that remain the same or that function in the same manner as those in the pumping unit according to FIG. 1 through FIG. 5 have been labeled with the same reference numerals.

Figure 7:
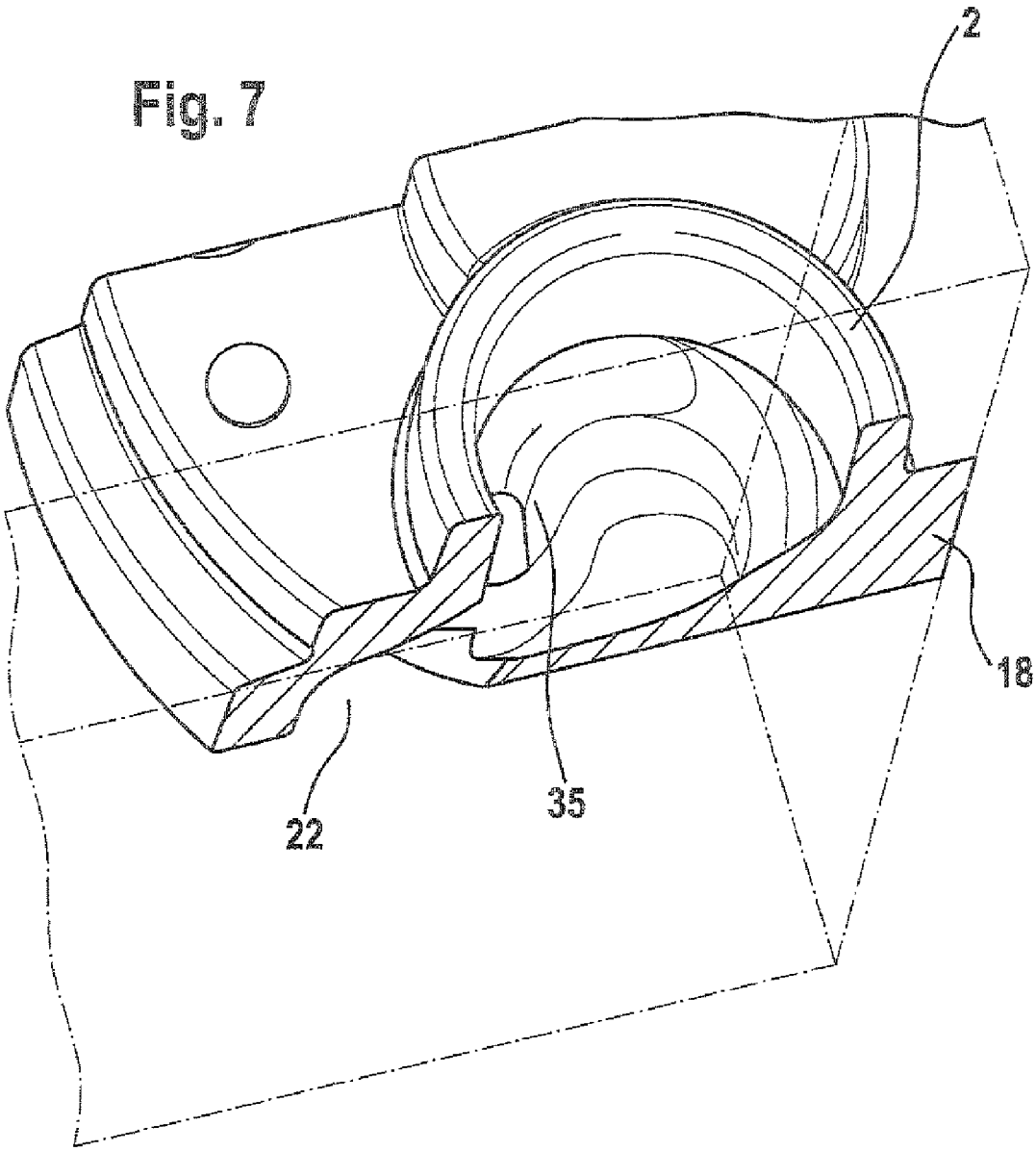
FIG. 7 is a three-dimensional sectional view of the suction cover according to FIG. 1.

FIG. 7 is a three-dimensional sectional view of the suction cover according to FIG. 1.

In the view according to FIG. 7, parts that remain the same or that function in the same manner as those in the pumping unit according to FIG. 1 through FIG. 6 have been labeled with the same reference numerals.

The foregoing relates to the preferred exemplary embodiment of the invention, it being understood that other variants and embodiments thereof are possible within the spirit and scope of the invention, the latter being defined by the appended claims.

The invention claimed is:

1. A pumping unit having an inlet conduit that is connected to a pump chamber containing a rotor, the inlet conduit narrowing from an inlet cross section to an outlet cross section at an outlet into the pump chamber, wherein the outlet is essentially provided in a first of four quadrant in relation to the inlet cross section and the narrowing of the inlet conduit occurs essentially in the other quadrants, with a narrowing wall of the inlet conduit being formed by a plane-forming contour that that extends around from one side of the outlet to an other side of the outlet, the plane-forming contour shaped so that as it does so, it becomes increasingly flat in relation to a plane of the outlet.

2. The pumping unit as recited in claim 1, wherein the plane-forming contour begins spaced axially apart from the outlet and transitions continuously, viewed in an axial direction, into the plane of the outlet.

3. The pumping unit as recited in claim 1, wherein at or near the one side of the outlet, the plane-forming contour forms a step-shaped shoulder that transitions continuously, viewed in a circumference direction, into the plane of the outlet.

4. The pumping unit as recited in claim 3, wherein the step-shaped shoulder is rounded and has a radius.

5. The pumping unit as recited in claim 4, wherein the radius of the step-shaped shoulder increases in a circumference direction and transitions with an increasingly large radius into the plane of the outlet.

6. The pumping unit as recited in claim 1, wherein the plane-forming contour is embodied as curved in such a way that a medium flow traveling into the inlet conduit is guided in a circumference direction of the inlet conduit toward the outlet.

7. The pumping unit as recited in claim 1, wherein the plane-forming contour extends curved in an S-shape, with a first curve oriented toward an outside thereof and a second curve following the first curve in a flow direction oriented toward an inside thereof.

8. The pumping unit as recited in claim 1, wherein a radial dimension of the inlet conduit remains essentially constant in an axial direction in a region of the first quadrant, and the outlet is situated with one side in this section of the inlet conduit.

9. The pumping unit as recited in claim 1, wherein at the outlet, the inlet conduit opens into a pumping conduit, which extends transversely in relation to a longitudinal span of the inlet conduit.

* * * * *

UNITED STATES PATENT AND TRADEMARK OFFICE

CERTIFICATE OF CORRECTION

PATENT NO. : 8,356,969 B2
APPLICATION NO. : 12/444054
DATED : January 22, 2013
INVENTOR(S) : Luo et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 966 days.

Signed and Sealed this
First Day of September, 2015

Michelle K. Lee

Michelle K. Lee
*Director of the United States Patent and Trademark Office*